US005635920A

United States Patent [19]

Pogue et al.

[11] Patent Number: 5,635,920

[45] Date of Patent: Jun. 3, 1997

[54] REMOTE TRAFFIC SIGNAL INDICATOR

[75] Inventors: J. B. Pogue, 501 Skylark, Monahans, Tex. 79756; John E. Cope, Box 272, Fort Stockton, Tex. 79735

[73] Assignees: J. B. Pogue, Monahans; John E. Cope, Fort Stockton; Glenn R. Vance, Monahans, all of Tex.; a part interest

[21] Appl. No.: 348,869

[22] Filed: Nov. 29, 1994

[51] Int. Cl.[6] ..... G08G 1/00

[52] U.S. Cl. ..... 340/901; 340/905; 340/906

[58] Field of Search ..... 340/901, 902, 340/904, 905, 906, 907, 425.5, 988, 989, 991; 455/103

[56] References Cited

U.S. PATENT DOCUMENTS

| | | | |
|---|---|---|---|
| 2,442,851 | 6/1948 | Halstead . | |
| 2,968,802 | 1/1961 | Flory et al. | 340/901 |
| 3,646,580 | 2/1972 | Fuller et al. | 340/989 |
| 3,899,671 | 8/1975 | Stover | 340/905 |
| 4,228,419 | 10/1980 | Anderson | 340/906 |
| 4,447,800 | 5/1984 | Kasuya et al. | 340/904 |
| 4,816,827 | 3/1989 | Baloutch et al. | 340/905 |
| 4,921,468 | 5/1990 | Miwa | 340/905 |
| 5,126,735 | 6/1992 | Trevijano | 340/901 |
| 5,172,113 | 12/1992 | Hamer | 340/906 |
| 5,280,632 | 1/1994 | Jung-Gon | 340/905 |
| 5,289,181 | 2/1994 | Watanabe et al. | 340/902 |
| 5,444,742 | 8/1995 | Grabow et al. | 340/905 |

FOREIGN PATENT DOCUMENTS

| | | | |
|---|---|---|---|
| 2265041 | 9/1993 | United Kingdom | 340/905 |

*Primary Examiner*—Brent A. Swarthout

*Attorney, Agent, or Firm*—Edwin E. Greigg; Ronald E. Greigg

[57] ABSTRACT

A system and method for pre-warning a driver of a vehicle when the vehicle is approaching a traffic light or warning sign. Transmitters of highly directional energy are installed at the traffic lights and/or signs while receivers for this radiant energy are installed on each vehicle. False warnings are avoided by transmitting at least two simultaneous coded signals from the traffic light/sign. A first signal, called a direction signal, indicates the presence of a light/sign while a second signal, called a status signal, indicates the status of the traffic light/sign, e.g. red, yellow, green, "Railroad Crossing", etc. The two signals may be transmitted using two different kinds of radiant energy, e.g. infrared and laser beams.

11 Claims, 5 Drawing Sheets

REMOTE TRAFFIC SIGNAL INDICATOR

FIELD OF THE INVENTION

This invention relates to a system and method of transmitting and receiving warning signals for remotely informing the driver of a vehicle that the vehicle is approaching a traffic light or traffic sign. Transmitters of radiant energy are installed at traffic lights and/or traffic warning signs while receivers of radiant energy are installed on vehicles so that drivers are alerted in advance about traffic lights and/or warning signs.

DESCRIPTION OF PRIOR ART

Prior art systems have given warnings to drivers when their vehicles are approaching traffic lights or warning signs but they have not provided the means or method to avoid erroneous signals disclosed by this invention. U.S. Pat. No. 2,442,851 to Halstead (1948) discloses a system for presenting aural or visual signals within the vehicle when the vehicle approaches a traffic signal.

U.S. Pat. No. 2,968,802 to Flory et al (1961) shows a system using radio signals to transmit signals to vehicles indicating an alarm, warning or stop signals. U.S. Pat. No. 5,280,632 to Jung-Gon (1994) uses radio signals to transmit warning signals to receiving vehicles to warn of dangerous areas such as a sharp curve or a steep hill.

U.S. Pat. No. 4,816,827 to Baloutch et al (1989) shows a system using infrared radiation signals to transmit a signal to a vehicle for activating an audible signal in the vehicle. The infrared radiation signals are coded and a receiver in the vehicle decodes the received infrared signal.

U.S. Pat. No. 5,126,735 to Trevijano (1992) shows a system using coded infrared rays to communicate warning signals between vehicles.

None of the prior art systems teach the means or method of the present invention for minimizing the chance of false signals.

OBJECTS AND ADVANTAGES OF THE INVENTION

An object of this invention is to transmit signals to vehicles to remotely warn of situations further along the road wherein the signals are transmitted so as to minimize the chance of erroneous signals.

A further object of the invention is to transmit traffic signals to vehicles wherein each valid transmittal includes two encoded signals.

Another object of the invention is to transmit signals to vehicles wherein each valid transmitted signal includes one coded signal which indicates the presence of a traffic light or warning sign and a second coded signal representing the information from the traffic light or the warning sign.

Also an object of the invention to use one form of radiant energy to transmit a first signal indicating the presence of a traffic light or warning sign and to use a second form of radiant energy to simultaneously transmit a second signal representing the information from the traffic light or warning sign.

Still a further object of the invention is to use infrared radiation, laser beams, or other highly directional radiant energy with one of the transmitted signals being one form of radiant energy and the other transmitted signal being another form of radiant energy.

Another object of the invention is to use receivers on the vehicles wherein the receivers have a high front-to-back ratio so that only signals in front of the vehicle are accepted.

SUMMARY OF THE INVENTION

Each year there are numerous deaths and thousands of dollars of property lost because drivers are unaware that they are approaching traffic lights, stop signs, railroad crossings, warning signs, etc. In accordance with the present invention, each vehicle will be provided with a signal system inside the vehicle to warn the driver in advance when he is approaching a traffic light or sign. Visual warnings, sound warnings and voice messages may be produced within the vehicle. The speaker in the vehicle's radio receiver may be used to produce audible warnings.

The system according to the invention includes stationary transmitters at each traffic light or sign as well as receivers in each vehicle. In order to eliminate false signals from being received by the vehicles, each valid signal is actually two distinct signals: (1) a Direction signal which is transmitted in each of the relevant directions from a traffic light or traffic sign, and (2) a Status signal which transmits the status of the traffic light or traffic sign, e.g. green, yellow, red, or a warning message. The system is arranged so that both signals must be received by a vehicle before a valid signal is indicated. The reception of a Direction signal by the vehicle must occur before the Status signal can be received. The Direction and Status transmissions can differ in frequency and/or kind and the requirement of the reception of both of these signals minimizes the chance of the false readings being reported in the vehicle.

Both the Direction and Status signals are encoded and transmitted using highly directional radiant energy. For a Direction signal to be valid it must be transmitted as radiant energy having the proper wavelength. Also the signal must be rapidly modulated on and off at a selected frequency. This modulation frequency is referred as the carrier frequency. Furthermore, this carrier frequency signal is encoded by turning the carrier frequency on and off in a predetermined sequence. One method of encoding the carrier frequency is to turn it on and off at a fixed frequency. This on and off frequency is referred to as the encode frequency. In such a situation, a signal would be a valid signal only if it has a proper wavelength, a proper carrier frequency and a proper encode frequency. Likewise, for a Status signal to be valid it would have to have a proper wavelength, a proper carrier frequency and a proper encode frequency. Infrared, laser, ultrahigh frequency radio or other highly directional radiant energy may be used to carry the signals.

DRAWING FIGURES

FIG. 10A illustrates the input and FIG. 10B illustrates the output.

DETAILED DESCRIPTION OF THE INVENTION

Figure 1:
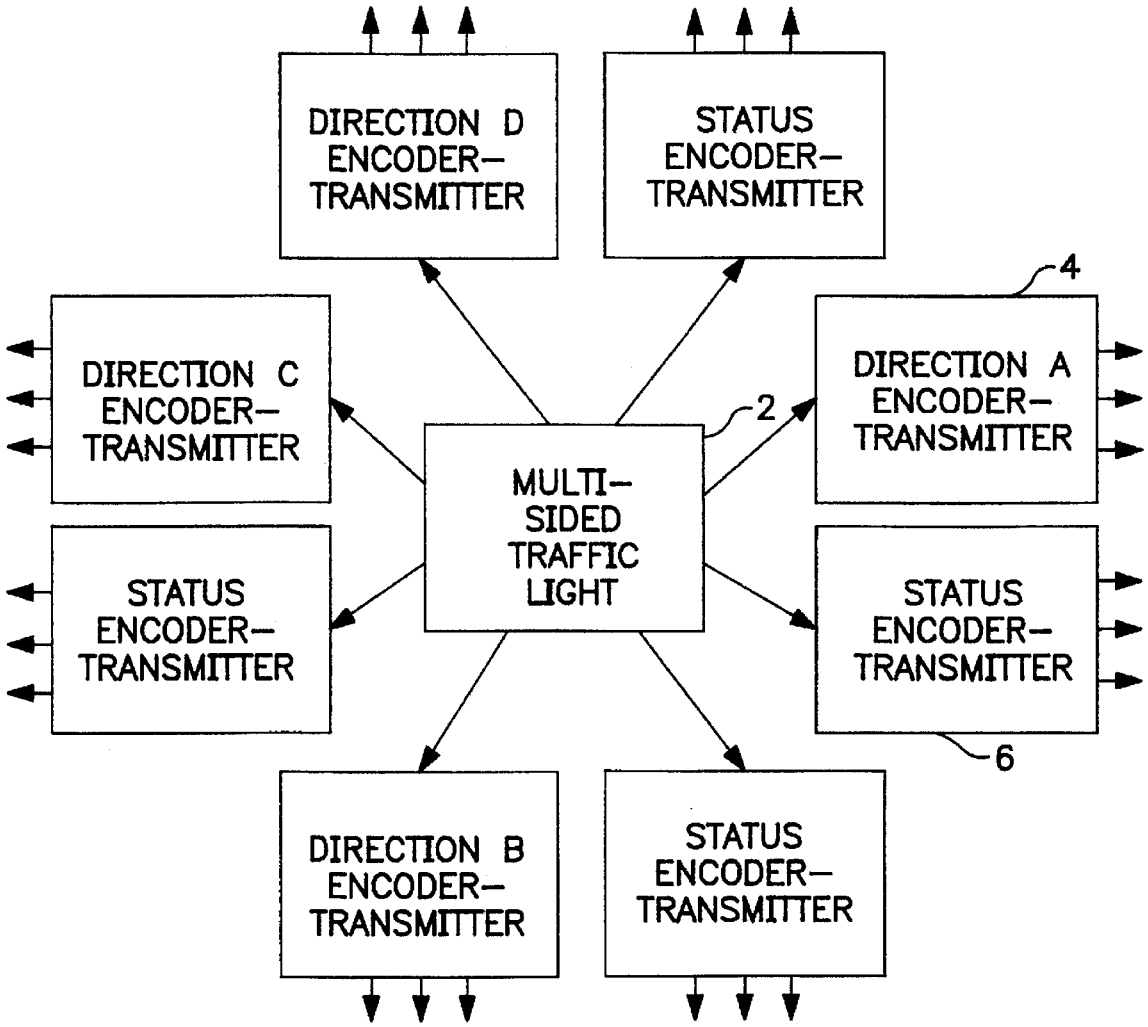
FIG. 1 shows a block diagram of the parts of the system according to the invention located at one multi-way traffic light.

FIG. 1 shows a block diagram of the components of the invention at a multi-sided traffic light installation. Block 2 represents an ordinary arrangement of traffic lights at an intersection of two streets or roads. The lights can be on a single four-sided fixture or in four or more separate fixtures. Mechanical or electrical connections from the lights are used to activate the Direction Encoder-Transmitters 4 and the Status Encoder-Transmitters 6. For a four way installation there would be four pairs of these encoder-transmitters. Of course instead of four roads coming together, the intersection could be formed by the meeting of three, five or more roads. Details of the encoder-transmitters will be discussed later with reference to FIGS. 4 and 5.

Figure 2:
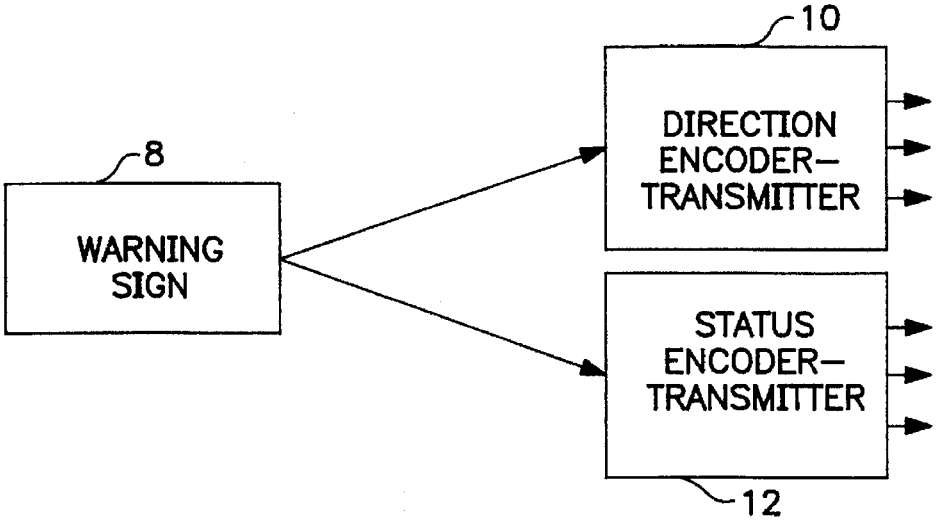
FIG. 2 shows a block diagram of the parts of the system located at a warning sign.

It is clear that the invention can be used advantageously at traffic signs as well as at traffic lights. For example, it could be used with warning signs, such as SHARP CURVE, STEEP HILL, RAILROAD CROSSING, CONSTRUCTION AHEAD, DETOUR, SCHOOL ZONE, ICE ON BRIDGE, SPEED LIMIT 20, etc. FIG. 2 shows a block diagram of one such installation. The warning sign 8 could be any one of several types of signs such as those just mentioned. The Direction Encoder-Transmitter 10 could be similar to the equivalent equipment in FIG. 1. The accompanying Status Encoder-Transmitter 12 could continuously transmit an encoded signal which would correspond to the message on the sign itself. Of course the transmitters could be turned off when not needed. For example, the SCHOOL ZONE transmitter could be turned off when the school was not in operation.

Figure 3:
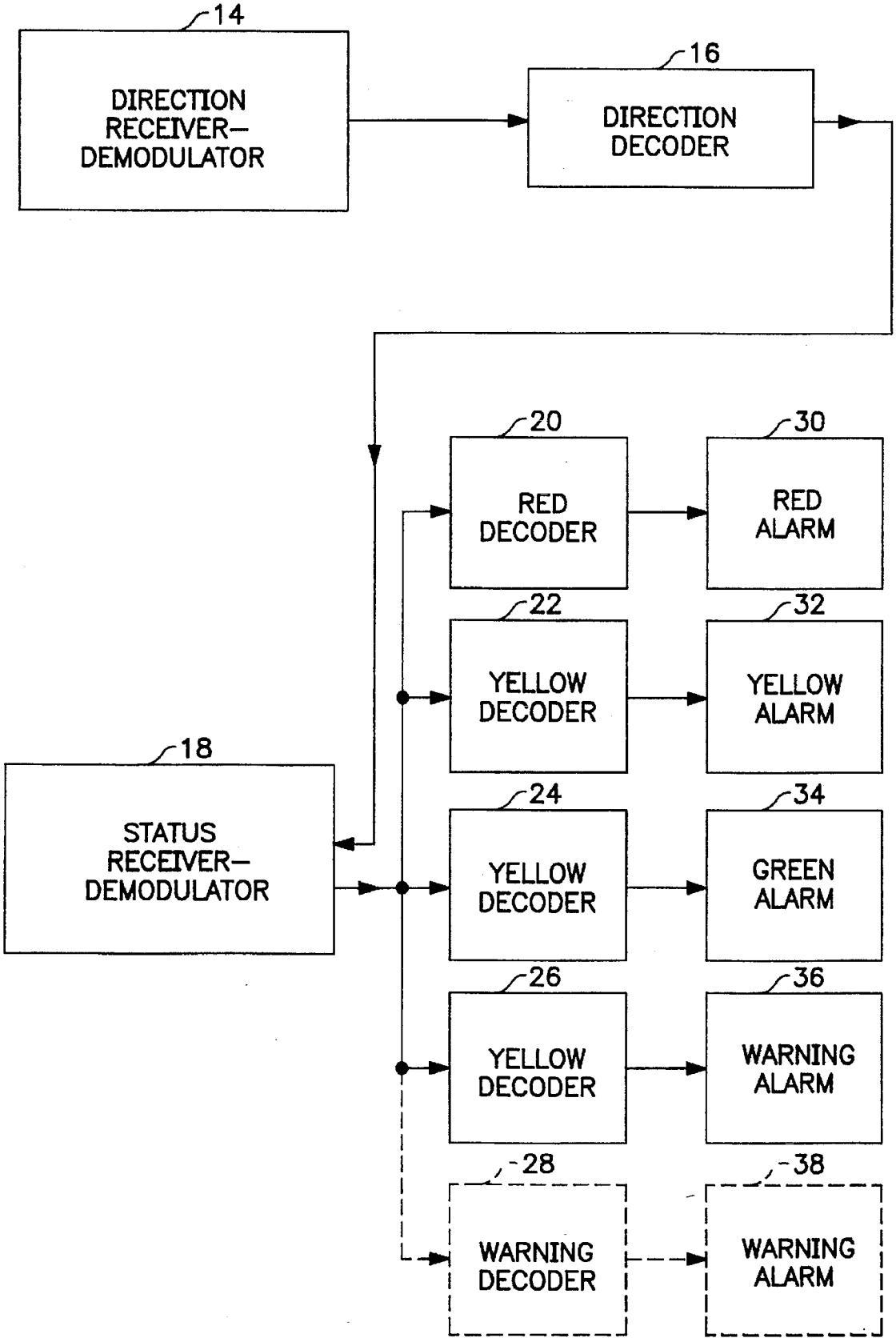
FIG. 3 shows a block diagram of the parts of the system located at an individual vehicle.

FIG. 3 shows a block diagram of the equipment which would be installed on a vehicle according to the invention. Each vehicle would include a Direction Receiver-Demodulator 14 with a Direction Decoder 16 as well as a Status Receiver-Demodulator 18 and accompanying Decoders 20 through 28 and Alarms 30 through 38. The details of the receiver-demodulators are discussed below in reference to FIGS. 6–9, 10A and 10B. When a direction signal is received and demodulated by Receiver-Demodulator 14, it is decoded by Direction Decoder 16. If the received signal is a valid, properly coded direction signal, the output of Direction Decoder 16 enables the Status Receiver-Demodulator 18 to receive and demodulate the status signal and pass the demodulated status signal to the bank of Decoders 20–28. These decoders can determine if a red, yellow, green or other signal has been received and then a corresponding visual alarm, audio alarm or message is energized within the vehicle. The devices for generating the visual alarm, audio alarms or messages are represented as Alarms 30–38 in FIG. 3. In addition to decoders for red, yellow and green signals, the system can also have decoders for other types of warning signs. These decoders and their associated alarm devices are indicated as Decoders 26 and 28 and Alarms 36 and 38 in FIG. 3. Decoder 28 and Alarm 38 are shown in dashed form to indicate that the number of decoders and alarm devices installed in vehicles can vary depending upon the actual system involved.

It can be seen that by requiring that both a direction signal and a status signal be received simultaneously, the system according to the invention minimizes the opportunity for false signals.

Figure 4:
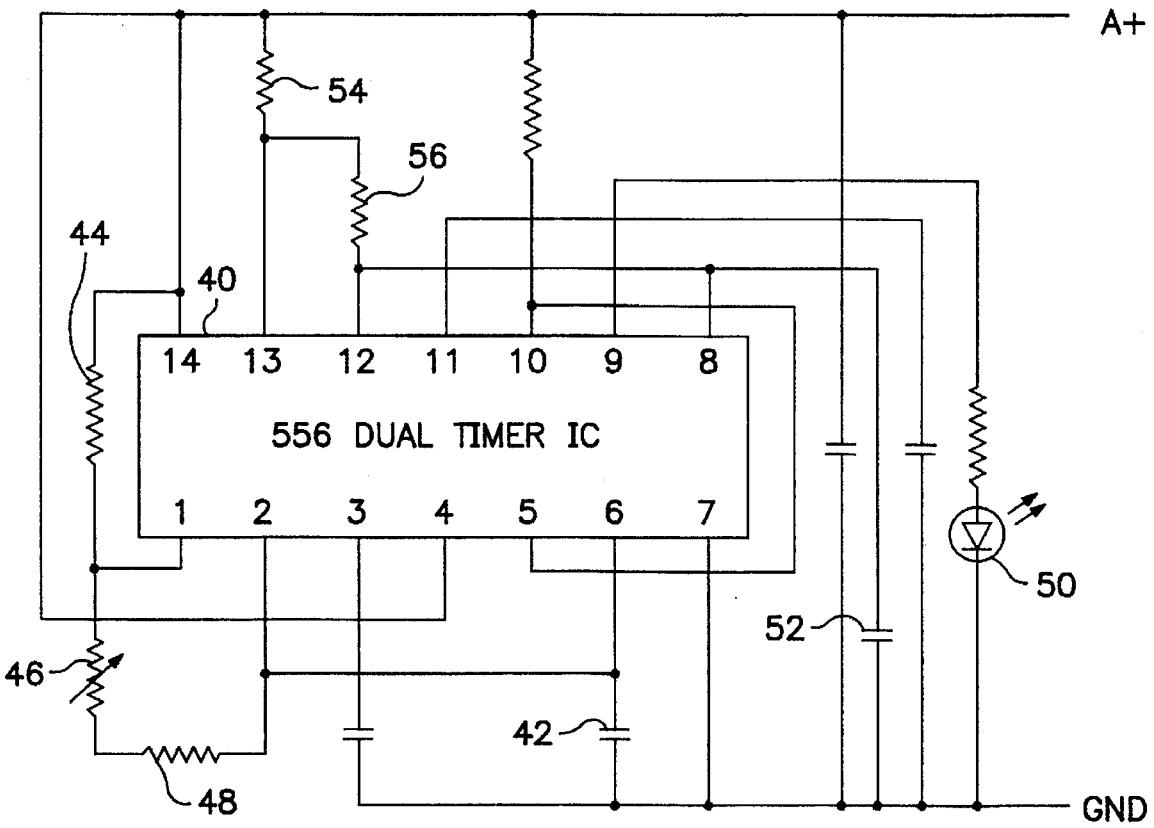
FIG. 4 shows circuit details of one of the Direction Encoder-Transmitters shown in FIG. 1.

FIG. 4 illustrates a simple circuit for implementing the Encoder-Transmitters such as block in FIG. 1. The 556 integrated circuit 40 is a dual timer circuit such as that described in detail in the book Integrated Circuit and Waveform Generator Handbook by R. M. Marston (1990), pages 87–88 and Radio Shack's Engineer's Mini-Notebook—555 Timer IC Circuits by Forrest M. Mims (1984), pages 10–23. The pin-outs for the 556 IC dual timer 40 are as follows:

| FUNCTION | 1st TIMER | 2nd TIMER |
|---|---|---|
| Ground | 7 | 7 |
| Trigger | 6 | 8 |
| Output | 5 | 9 |
| Reset | 4 | 10 |
| Control V | 3 | 11 |
| Threshold | 2 | 12 |
| Discharge | 1 | 13 |
| Vcc | 14 | 14 |

Figure 10A:
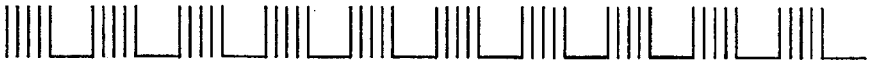
FIGS. 10A and 10B show timing diagrams of the input to and the output from the Direction Receiver-Demodulator of FIG. 3.

The 556 IC can be used in the encoder-transmitters in the present invention by setting the first timer to oscillate at a first frequency and allowing the output on pin 5 of this first timer to control the oscillation of the second timer. The frequencies are adjusted by choosing the proper values for the accompanying resistors and capacitors. The output on pin 9 of the second timer can be used to drive an infrared transmitter 50. The output on pin 9 may be amplified before being applied to the radiant energy transmitter 50 and the transmitter will be chosen to generate an infrared signal having the desired power. The frequency generated by the first timer is called the encode frequency herein and may be set to a value of 100 to 1000 Hz, while the frequency generated by the second timer is called the carrier frequency herein and may be set at 40 kHz. In this way the output of the circuit shown in FIG. 4 would be bursts of 40 kHz signals separated by time intervals during which the second timer is not oscillating. This output is transmitted and is illustrated in FIG. 10A. The clusters of vertical lines in FIG. 10A are meant to signify the bursts of the 40 kHz carrier frequency. The encode frequency is set essentially by the charge and discharge times of capacitor 42 in FIG. 4. This capacitor is charged through resistors 44, 46 and 48 and discharged through resistors 46 and 48. The values of capacitor 42 and resistors 44, 46 and 48 can be chosen to set the encode frequency. In a similar manner, the carrier frequency is set essentially by the charge and discharge times of capacitor 52. This capacitor is charged through resistors 54 and 56 and discharged through resistor 56. The values of the elements 52, 54 and 56 can be chosen to set the carrier frequency.

The Status Encoder-Transmitters, for example block 6 in FIG. 1, are similar to the Direction Encoder-Transmitters but the status encoders are arranged so that the encode frequency changes as the traffic light changes from green to yellow to red. The carrier frequency produced by the Status Encoder-Transmitter may be the same as the carrier frequency produced by the Direction Encoder-Transmitters or may be an entirely different carrier frequency.

Figure 5:
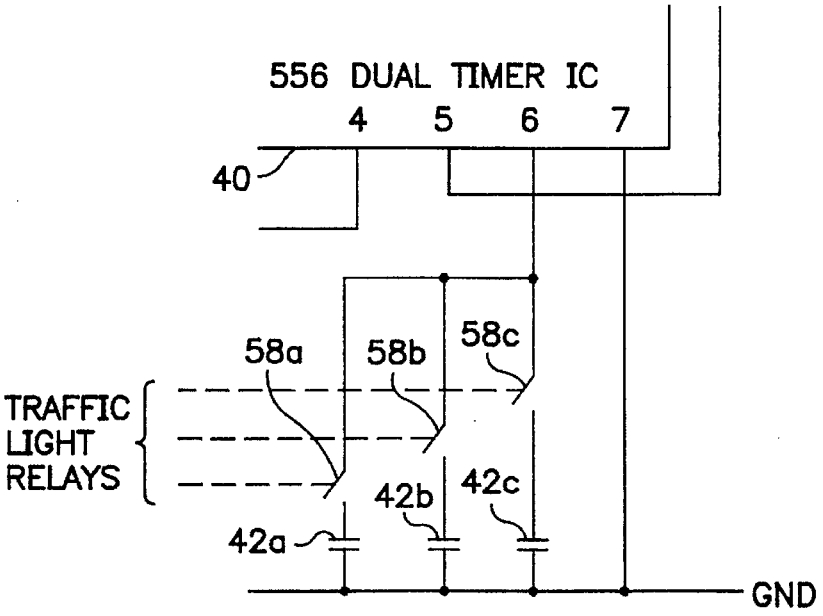
FIG. 5 shows circuit details of one of the Status Encoder-Transmitters shown in FIG. 1.

FIG. 5 shows a partial view of a Status Encoder-Transmitter wherein components which act similarly to those in the Direction Encoder-Transmitter of FIG. 4 are given similar numbers with a letter added. It can be seen that the encode frequency, which is produced by the first timer in the 556 dual timer, can be changed by switching-in different sized capacitors. Just as the charge time and discharge time of capacitor 42 in FIG. 4 is used in determining the encode frequency of the Direction Encoder-Transmitter in FIG. 4, capacitors 42*a*, 42*b* and 42*c* in FIG. 5 are used in determining the encode frequencies of the Status Encoder-Transmitter for red, yellow and green signals. These capacitors are switched in and out of the timer circuit under control of the traffic light. The switches 58*a*, 58*b* and 58*c* may be electro-mechanical or electronic. When the traffic light turns green, switch 58*a* is closed and capacitor 42*a* is used in determining the encode frequency which then triggers on and off the carrier frequency transmitted by the Status Encoder-Transmitter. Of course, other methods could be devised to produce the different encode frequencies for the different traffic light colors.

FIG. 10A shows a timing diagram of the transmitted signal. It illustrates bursts of infrared light with each burst comprising infrared blinking on and off at the carrier frequency (e.g 40 kHz) and the carrier frequency is triggered on and off at the encode frequency (e.g 150 Hz).

Figure 6:
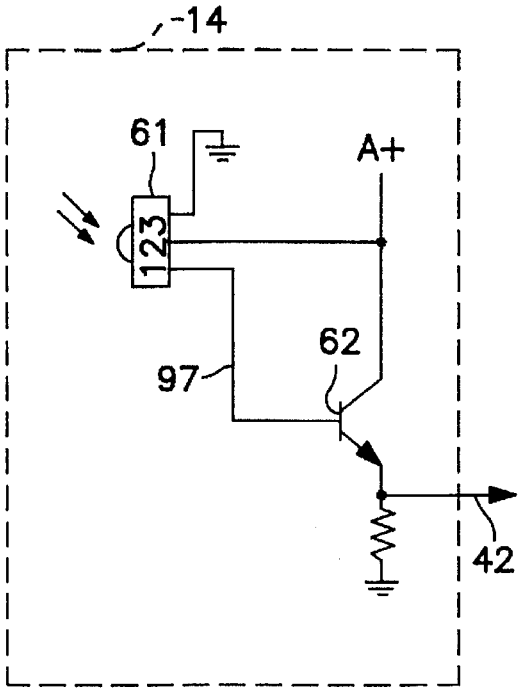
FIG. 6 shows details of the Direction Receiver-Demodulator shown in FIG. 3.
Figure 9:
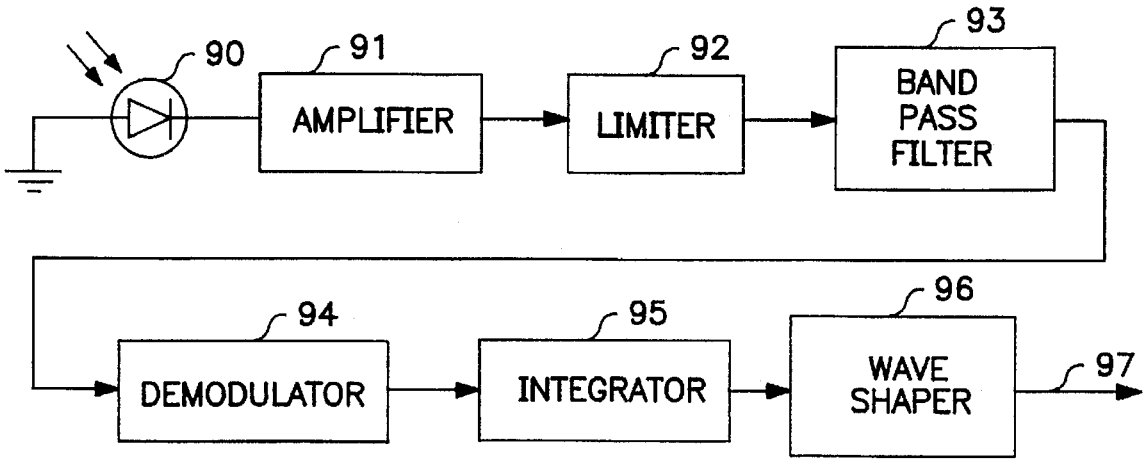
FIG. 9 shows further details of the Direction Receiver-Demodulator of FIG. 6.
Figure 10B:
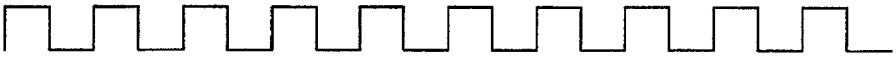

The transmitted infrared signal of FIG. 10A is received by receiver-demodulators such as block 14 in FIG. 3 located in approaching vehicles. FIG. 6 shows some of the details of such a Direction Receiver-Demodulator 14. Element 61 in FIG. 6 can be a GP1U52X infrared receiver-demodulator available from Radio Shack (Cat. No. 276-137). The GP1U52X is presented only as an example of a type of element which can perform the required functions of a receiver-demodulator. Obviously, the receiver-demodulator could be built using other hardware components. The GP1U52X is a hybrid IC/infrared detector with a photo diode that has its peak sensitivity in the near infrared range and has a built-in filter to block visible light. FIG. 9 shows a block diagram of the internal operation of the GP1U52X. The output of photo diode 90 feeds into preamplifier 91 and limiter 92 to provide a clean signal to the rest of the circuit. Band pass filter 93 rejects all signals outside the band pass. For the GP1U52X the band pass is 40 kHz ±4 kHz but other carrier frequencies and band pass widths could be used. The remaining signal is fed to demodulator 94, integrator 95 and waveshaper circuit 96. The output of waveshaper 96 appears on line 97 and as can be seen in FIG. 6 this output drives a one-transistor amplifier 62 whose output appears on line 42. The output of the waveshaper is shown in FIG. 10B and it can be seen that it is an envelope of the received signal shown in FIG. 10A with the 40 kHz carrier frequency removed. This envelope is a series of rectangular pulses whose frequency is equal to the encode frequency.

Figure 8:
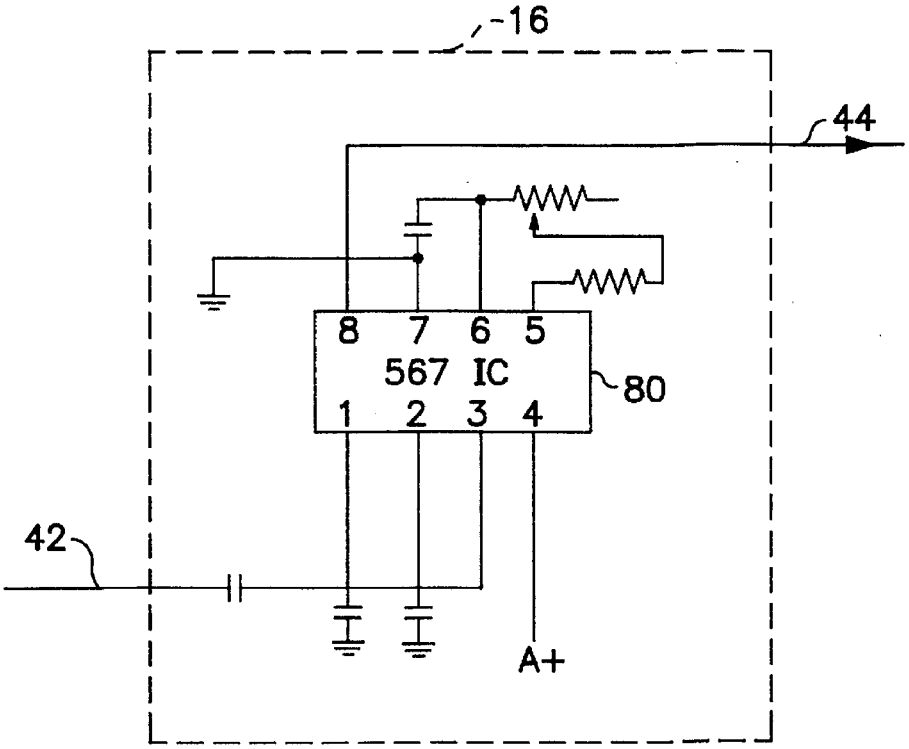
FIG. 8 shows details one of the Direction Decoders shown in FIG. 3.

As can be seen from FIG. 3 the output of the Direction Receiver-Demodulator 14 is fed via line 42 to Direction Decoder 16. The decoder is preset to the relevant encode frequency so that the decoder recognizes when it receives a series of pulses having a frequency that is within a narrow range of the preset direction encode frequency value. FIG. 8 shows a diagram of a 567 IC chip 80 which can be used to implement a decoder such as Direction Decoder 16. The operation of a 567 IC is explained on pages 214–225 of Marston's handbook cited above. Of course, the decoder could be constructed using other components than the 567 IC chip.

The 567 IC chip 80 shown in FIG. 8 includes a voltage controlled oscillator (VCO) which is set to generate internally a frequency equal to the encode frequency. This frequency is compared with the frequency received on terminal 3 of the chip via line 42. When the input frequency on line 42 coincides with the internally generated frequency, the output on terminal 8 is pulled toward ground and this ground signal is available on line 44 which is connected to Status Receiver-Demodulator 18 in FIG. 3.

Figure 7:
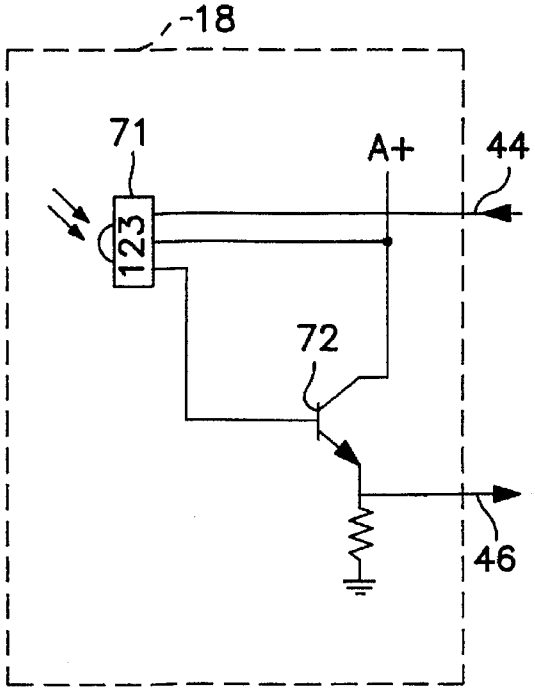
FIG. 7 shows details of the Status Receiver-Demodulator shown in FIG. 3.

Status Receiver-Demodulator 18 in FIG. 7 is similar to Direction Receiver-Demodulator 14 in FIG. 6 except that terminal 3 of the GP1U52X chip 71 in FIG. 7 is not connected directly to ground. FIG. 6 shows that in the Direction Receiver-Demodulator 14 terminal 3 of chip 61 is permanently connected to ground. Thus Direction Receiver-Demodulator 14 is continuously ready to receive the incoming infrared signals. However, FIG. 7 shows that terminal 3 of chip 71 is not permanently connected to ground so that the Status Receiver-Demodulator 18 is not continuously enabled to receive an incoming infrared signal. It can be seen that the Status Receiver-Demodulator is activated only if a valid Direction signal is found present by the Direction Receiver-Demodulator 14. Thus, the simultaneous reception of a valid Direction signal and a valid Status signal is required before a warning signal is issued in the vehicle. In this way false signals are minimized.

FIGS. 6, 7 and 8 show how the activation of the Status Receiver-Demodulator 18 of FIG. 7 is accomplished. When an infrared signal of the proper wavelength modulated with the proper carrier frequency is received by Direction Receiver-Demodulator 14 of FIG. 6, it is demodulated whereby the carrier frequency is removed and the demodulated signal which includes the encode frequency is output on line 42 and forwarded to the Direction Decoder 16 in FIG. 8. Decoder 16 receives this demodulated signal and, if it determines that the proper encode frequency is present, a signal is output on line 44. The signal on line 44 is then forwarded to the Status Receiver-Demodulator 18 shown in FIG. 7 where it enables the receiver-demodulator chip 71 to accept a status signal.

Once the vehicle is receiving a proper Direction signal, i.e a signal with the correct wavelength, correct carrier frequency and correct direction encode frequency, and is also simultaneously receiving a Status signal having a correct wavelength and correct carrier frequency, the demodulated Status signal is presented simultaneously to red, yellow, green and/or other warning decoders. This can be seen in FIG. 3 where the demodulated output of Status Receiver/Demodulator 18 is fed simultaneously to decoders 20, 22, 24, 26 and 28. These decoders check the encode frequency of the demodulated status signal to determine whether it corresponds to the red, yellow, green or other encode frequency. If one of the decoders finds a proper encode frequency, the corresponding alarm is activated. For example, if Red Decoder 20 receives its encode signal, Red Alarm 30 will light. The red, yellow, green, etc. decoders of FIG. 3 perform their functions in the same way as Direction Decoder 16 shown in FIG. 8 described above.

Figure 11:
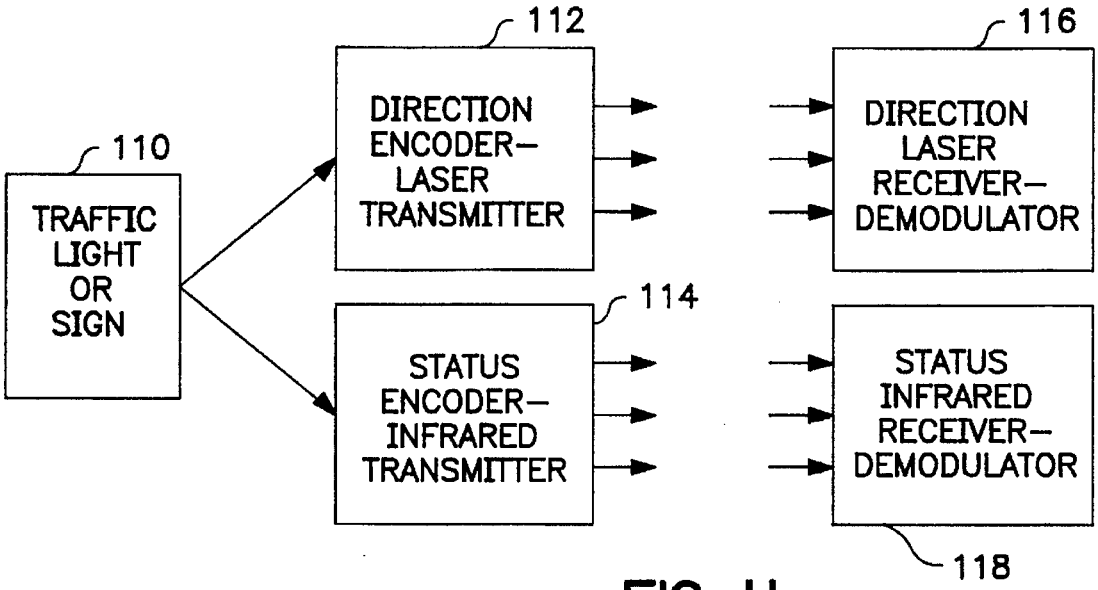
FIG. 11 illustrates an embodiment of the invention utilizing different types of radiant energy for transmitting direction and status signals.

As stated previously, the chances of false signals can be reduced even further by using different kinds of highly directional radiant energy to transmit the Direction signals and to transmit the Status signals. An embodiment incorporating this feature is illustrated in FIG. 11. In this figure the Direction signals are transmitted as laser signals while the Status signals are transmitted as infrared signals. In both cases the signals can be transmitted with selected carrier frequencies and selected encode frequencies.

Although the description above sets forth specific embodiments of the invention, it should not be construed in any way as limiting the scope of the invention. The scope of the invention should be determined by the appended claims and their legal equivalents rather than by the embodiments described above and the suggested modifications.

What is claimed is:

1. A system for warning an approaching vehicle of the presence and condition of a fixed traffic device, said system comprising:

first stationary transmitting means for continuously transmitting a first highly directional signal indicating the presence of said fixed traffic device, said first transmitting means transmitting said first signal as radiant energy having a first wavelength;

second stationary transmitting means for continuously transmitting a second highly directional signal indicating the condition of said fixed traffic device, said second transmitting means transmitting said second signal as radiant energy having a second wavelength different from said first wavelength;

first receiving means on said vehicle for receiving said first signal and producing an output indicating the presence of said traffic device;

second receiving means on said vehicle for receiving said second signal indicating the condition of said traffic device;

means connecting the output of said first receiving means to said second receiving means to enable said second receiving means to receive said second signal only when said first signal is being received by said first receiver; and means indicating the condition of said traffic device if and only if both of said two signals are simultaneously received.

2. The system according to claim 1, wherein said first signal is encoded and said second signal is encoded.

3. The system of claim 1, wherein at least one of said signals is transmitted as an infrared signal.

4. The system of claim 3, wherein said infrared signal is oscillated on and off at a carrier frequency.

5. The system of claim 4, wherein said carrier frequency is oscillated on and off at an encode frequency which is lower than said carrier frequency.

6. The system of claim 1 wherein the traffic device is a traffic light having at least two possible colors and the condition is the current color of the traffic light.

7. The system of claim 1 wherein the traffic device is a traffic sign and the condition is the message depicted on said sign.

8. A system for warning an approaching vehicle of the presence and condition of a stationary traffic device, said system comprising:

two stationary transmitter means at said stationary traffic device, said transmitter means each emitting highly directional radiant energy in a narrow beam toward said approaching vehicle, the radiant energy emitted from one of said transmitter means being infrared energy and the radiant energy emitted from the other of said transmitter means being laser energy; a first of said transmitter means transmitting highly directional radiant energy indicating the presence of said traffic device and a second of said transmitter means transmitting highly directional radiant energy indicating the condition of said traffic device; two receiver means having high front-to-back ratios on said vehicle for receiving said highly directional radiant energy, said two receiver means having high front-to-back ratios so that only signals arriving from in front of said vehicle are accepted, a first of said receiver means receiving energy from said first transmitter means and producing an output indicating the presence of said traffic device and a second of said receiver means receiving energy from said second transmitter means and producing an output indicating the condition of said traffic device;

means connecting said output from said first receiver means to said second receiver means to activate and deactivate said second receiver means depending upon the presence and absence, respectively, of said output signal from said first receiving means; and indicator means for indicating the condition of said traffic device if and only if said signals are received simultaneously by said first and second receiver means.

9. The system according to claim 8 wherein said radiant energy is encoded.

10. A method for warning an approaching vehicle of the presence and condition of a fixed traffic device, said method comprising the steps of:

continuously transmitting from a first stationary transmitter a first highly directional signal indicating the presence of said fixed traffic device, said first highly directional signal being transmitted as radiant energy having a first wavelength;

continuously transmitting from a second stationary transmitter a second highly directional signal indicating the condition of said fixed traffic device, said second highly directional signal being transmitted as radiant energy having a second wavelength different from said first wavelength;

receiving said first signal at a first receiver on said vehicle and producing an output denoting the presence of said traffic device;

selectively receiving said second signal at a second receiver on said vehicle denoting the condition of said traffic device;

connecting said output to said second receiver to selectively enable said second receiver only when said output denoting the presence of said traffic device is received by said first receiver; and indicating the condition of said fixed traffic device if and only if both of said two signals are simultaneously received.

11. The method of claim 10, wherein said first and second signals are encoded.

* * * * *